US006343395B1

(12) United States Patent
Schrell et al.

(10) Patent No.: US 6,343,395 B1
(45) **Date of Patent: *Feb. 5, 2002**

(54) APPARATUS AND PROCESS FOR WET-PROCESSING OF TEXTILE MATERIAL

(75) Inventors: Andreas Schrell, Kriftel; Ludger Wilbers, Niedernhausen, both of (DE)

(73) Assignee: DyStar Textilfarben GmbH & Co. Deutschland KG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,235

(22) Filed: Jun. 3, 1999

(30) Foreign Application Priority Data

Jun. 5, 1998 (DE) ..... 198 25 032

(51) Int. Cl.[7] ..... D06B 3/20

(52) U.S. Cl. ..... 8/152; 8/151; 68/19; 68/177; 68/184

(58) Field of Search ..... 8/151, 152; 68/177, 68/178, 181 R, 184, 19

(56) References Cited

U.S. PATENT DOCUMENTS

| | | | | |
|---|---|---|---|---|
| 2,624,189 A | * | 1/1953 | Pendleton | 68/19 |
| 3,213,470 A | * | 10/1965 | Yasawa et al. | 68/177 X |
| 3,493,321 A | | 2/1970 | Yokohama et al. | |
| 3,679,357 A | * | 7/1972 | Christ et al. | 68/177 X |
| 3,718,012 A | * | 2/1973 | Vinas | 68/177 X |
| 4,726,088 A | | 2/1988 | Eckrodt | |
| 4,947,660 A | | 8/1990 | von der Eltz et al. | |

FOREIGN PATENT DOCUMENTS

| | | | | |
|---|---|---|---|---|
| DE | 1 635 089 | | 2/1971 | |
| EP | 0 078 022 | | 5/1983 | |
| EP | 0 211 265 | | 2/1987 | |
| EP | 0 310 013 | | 4/1989 | |
| FR | 2 412 637 | | 7/1979 | |
| FR | 2681615 | * | 3/1993 | 68/177 |
| JP | 179865 | * | 10/1984 | 68/177 |

* cited by examiner

*Primary Examiner*—Philip R. Coe
(74) *Attorney, Agent, or Firm*—Connolly Bove Lodge & Hutz LLP

(57) ABSTRACT

The present invention relates to apparatus for the wet-processing of textile material, essentially comprising a vessel (1) comprising a fabric inlet (2), at least one nozzle (3) for applying a treatment liquor, an intensive zone (4) and a fabric outlet (5), wherein the vessel does not include a scray and has a minimized dead space through accurate fitment of the nozzle (3) and the intensive zone (4) into the vessel (1), and to a process for the wet-processing of textile material in the apparatus.

11 Claims, 1 Drawing Sheet

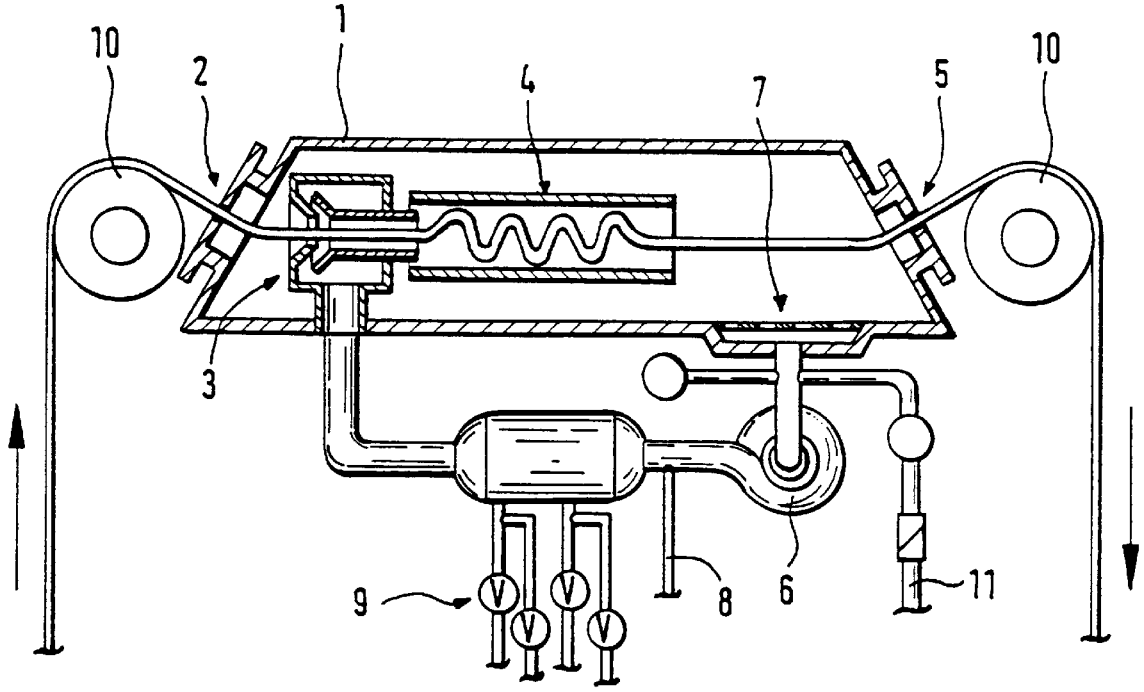
10
2
1
4
7
5
10
3
9
8
6
11

APPARATUS AND PROCESS FOR WET-PROCESSING OF TEXTILE MATERIAL

The present invention relates to apparatus and a process for the wet-processing, especially dyeing, of textile material by the exhaust method at a short liquor ratio in a very short time.

The currently most widely used method for dyeing circular knits is in jet machines by exhaust methods. In this technology, the textile material, gathered into a rope on a lot- or piecewise basis, is transported by a jet nozzle with treatment liquor, with air/steam or with a combination of the two media into a scray. The main feature of this processing technology is that the textile material in endless form is conveyed through the machine by the kinetic energy of the tangential jet, it being possible for gas and liquid flow to alternate or be combined during the different treatment stages, which permits a seamless transition from one dyeing step to another without a standstill of the material and under isothermal conditions.

For instance, EP-A 0 014 919 discloses an isothermal treatment process wherein the hot, preheated substrate is contacted with hot treatment liquor in a conventional jet machine by feeding one part of the treatment liquor to the scray space and the other to the jet nozzle and propelling the fabric selectively by means of a gas or by means of a liquid (i.e., the liquor) or by means of both together.

EP-A-0 078 022 describes a discontinuous dyeing method which is based on the aerodynamic propulsion of the textile rope and in which the fiber material is introduced into the dyeing jet in the form of batches. In the dyeing jet, the dyeing liquor is applied to the material by injecting it into the circulating gas stream in atomized form, each time giving fresh impetus to the circulation of the textile material and of the treatment liquor not absorbed by the material. The application of the total liquor quantity takes place over a plurality of circulations of the material, and the continuous recirculation of the excess liquor ensures uniform distribution of the liquor not only on but also in the rope. When the dyeing operation has ended, the piece-dyed material is removed again from the jet. This process is carried out in a jet machine of the conventional design, which is provided with additional means for spraying or atomizing the treatment agent into the propulsive gas stream.

The disadvantages of the cited processes include, for example, that purely cellulose articles still require the use of a relatively long liquor within the range from 6:1 to 8:1 and that it is therefore necessary to expend considerable quantities of thermal energy to heat these liquor quantities to the required temperatures. In addition, in these processes, the jet machine inevitably contains large amounts of excess, freely circulating liquor, so that the fabric is in contact with the liquor throughout the entire machine, even in the scray. The consequence of this is a relatively long exhaustion process for the dye and an even longer metering and fixing process.

There has therefore been no shortage of attempts to modify the application conditions for the colorant in such a way that a uniform dyeing may be obtained with ideally a single, ideally minimal, liquor application. For instance, EP-A 310013 describes a process for the continuous dyeing of textile material in rope form by means of jet machines in which the propulsive drive for the transportation of the material is supplied by the kinetic energy of a recirculating gas stream through the agency of the jet system. In the course of this dyeing process, the gas stream from the jet nozzle has continuously sprayed into it a dyeing liquor which already contains all the assisting chemicals required for fixing the dye. The liquor quantity is such that the entire applied liquor remains in the rope and there is no occurrence of excess, migrating liquor even during the subsequent fixation. However, this process is technically not implementable for reactive dyes, for example, ultimately for two reasons:

1. The marks produced during the single application of dye never level out in the further course of the isothermal process described, contrary to the statements in the reference. Since the dye solution already contains all the chemicals necessary for fixing reactive dyes, the fixing process starts immediately after the isothermal impregnation. During the continued transportation by the gas or gas/steam mixtures, no further migrating liquor is available for any leveling, and any unlevelness, once produced, is no longer evened out.

2. During the aerodynamic transportation of the rope by a thermally treated gas, applied dye solution is blown about, which causes local concentration differences and consequent unlevelness on the dyed material.

It is an object of the present invention to provide apparatus and a process which is free of the disadvantages mentioned and which affords dyeings of high quality with very short liquor ratios and within a very short time.

It has now been found that, surprisingly and contrary to a widely established view among those skilled in the art, it is possible for a textile rope material to be impregnated with level results in a jet transportation means in a very short liquor, for example with reactive dyes in a liquor ratio of 3:1 within only three to seven circulations, and to apply the necessary fixing alkali in additional 0.5 fabric weight units in the same apparatus in the continued process, i.e., for it to be dyed without incurring any unlevelness or marking on the textile material.

The present invention accordingly provides apparatus for the wet-processing of textile material, essentially comprising a vessel (1) comprising a fabric inlet (2), at least one nozzle (3) for applying a treatment liquor, which nozzle may also be the fabric inlet, an intensive zone (4) and a fabric outlet (5), wherein said vessel does not include a scray and has a minimized dead space through accurate fitment of said nozzle (3) and said intensive zone (4) into said vessel (1).

The present invention further provides a process for the wet-processing of textile material in apparatus according to the invention. The apparatus according to the invention enables textile fabric ropes to be wet-processed essentially just through a consistent separation of liquor stream and fabric stream after each passage through the apparatus of the invention.

The wet-processing of textile material for the purposes of the present invention is to be understood as meaning in particular the dyeing of natural or synthetic textile materials with textile dyes and the associated pre- and aftertreatment. The apparatus and process of the invention provide advantageous dyeings with water-soluble dyes on circular knits, especially circular knits and wovens composed of natural or modified hydroxyl-containing or natural, modified or synthetic carboxamido-containing fiber materials.

Hydroxyl-containing fiber materials are for example cellulosic fiber materials, such as the natural fiber materials, like cotton, jute and linen, and the modified fiber materials produced from cellulosic natural materials, like regenerated cellulose, for example filament viscose rayon, and cellulose fibers modified with amino-containing compounds, as are known for example from U.S. Pat. Nos. 5,507,840, 5,565,007 and 5,529,585, from EP-A 665311 and from DE-A 19519023.

Carboxamido-containing fiber materials are natural fiber materials, such as wool and other animal hairs, and also silk, and synthetic polyamide fiber materials, such as fiber materials composed of nylon-6, nylon-11 and nylon-6,6.

Water-soluble dyes are especially those which are anionic in nature, for example the so-called acid and direct dyes, but especially fiber-reactive dyes. As fiber-reactive dyes there may be mentioned in particular those where the fiber-reactive radical is a radical of the vinyl sulfone series, for example vinylsulfonyl or an ethylsulfonyl group which is substituted by an alkali-eliminable substituent in the β-position, such as β-sulfatoethylsulfonyl, β-acetoxyethylsulfonyl, β-chloroethylsulfonyl or β-thiosulfatoethylsulfonyl, also fiber-reactive radicals of the chlorotriazinyl, fluorotriazinyl, fluoropyrimidinyl, chlorofluoropyrimidinyl and dichloroquinoxazinyl series, and also dyes possessing combinations of such reactive groups. Fiber-reactive dyes of the kind mentioned are known to the person skilled in the art and are described for example in EP-A 513656.

The apparatus and the dyeing process of the invention can be used for treating all customary circular knit articles, such as single jersey, loop plush, interlock, fine rib, piqué and lining fabrics. In addition, the wet-processing of wovens is readily possible under the conditions of the invention.

In addition, however, it is also possible, if necessary with some modifications or configuration as HT apparatus, to dye textile material composed of polyester with disperse dyes or textiles composed of other materials with dyes appropriate for these materials.

The pre- and aftertreatments of the textile material which accompany the actual dyeing and which are likewise effected with the aid of the apparatus of the invention are in particular treatments for applying finishes, but primarily bleaching and washing processes.

The apparatus and dyeing process of the invention is used with particular preference for the dyeing of cellulosic circular knits and wovens with reactive dyes and the associated pre- and aftertreatments of the textile material.

The vessel (1) of the apparatus of the invention can in principle have any desired geometric shape, but is preferably cylindrical or cuboid. Owing to the absence of a scray and the accurate fitment of nozzle (3) and intensive zone (4), the vessel (1) has very small dimensions compared with customary dyeing jet machines and has a cubic capacity of advantageously less than 150 liters. Particularly preferably, its cubic capacity is 60 to 120 liters.

The fabric inlet (2) and fabric outlet (5) normally take the form of the customary dyeing jet entry and exit elements, which also serve as pressure seals in the case of HT processes. Such elements are well known to the person skilled in the art and are described for example in DE-A 2537665 and DE-A 2325604. The fabric outlet (5) is preferably connected to a wiping means, for example a rubber lip, a metal ring or a conical cylindrical segment, or already configured as such. The nozzle (3) is normally likewise a customary dyeing jet component which is constructed in such a way that it is driven hydraulically with flowing liquor by means of a pump (6) to provide forward drive and simultaneous impregnation of the textile material. The forward drive can be additionally supported by other means which the person skilled in the art knows for this purpose, for example winches or air jets.

The intensive zone (4) will usually be a cylindrical metal tube in which the material to be treated is additionally in intensive contact with the treatment liquor for a short time.

The vessel (1) preferably has at the lowest position of its underside one or more openings (7) through which the excess liquor can run off and is preferably recirculated back to the nozzle (3). It is particularly preferable for the vessel (1) to be perforated on its underside for this purpose.

As and when required, the apparatus of the invention may have further constructional elements, for example a fluff filter. If polyester is to be dyed with disperse dyes, the apparatus of the invention has to be for example equipped with appropriate heating means to provide the temperatures required for this purpose. There is generally also a need for makeup vessels for the liquor or other treatment liquids, and also for the corresponding feed and discharge lines, pumps and, as the case may be, heat exchangers. It is also advisable for that part of the fabric rope which is not passing through the apparatus of the invention to be plaited down in an intermediate store, or scray, placed suitably alongside the apparatus of the invention.

It is possible to construct the apparatus of the invention in such a way that the jet nozzle (3) also acts as fabric inlet (2).

FIG. 1 illustrates an embodiment of the apparatus of the invention in a nonlimiting manner.

The vessel (1) is provided with a fabric inlet (2) which receives the textile material to be wet-processed. The textile material leaves the vessel (1) via the fabric outlet (5), which is equipped with a wiping means. Located in the vessel (1) is the jet nozzle (3), which, by means of a pump (6), forces the liquor initially through the heat exchanger (9) and then into the nozzle (3). The textile fabric rope, which is forwarded by flowing liquor or else alternatively via winches (10), passes after the jet directly through the intensive zone (4) and is adjusted to a defined moisture pickup in the fabric outlet (5). The medium required for impregnating the textile material is ideally supplied via a makeup vessel (not depicted) to the pump (6) directly via the line (11). Excess liquor, which has been removed after passage through the intensive zone (4), runs back into the vessel (1) and, for example via perforated metal sheets (7), rapidly arrives on the suction side of the pump (6). A drain (8) is provided for liquor to be directly removable into the makeup vessel, for example so as to dissolve further chemicals by means of the recirculating liquor and subsequently to be resupplied to the working medium.

The dead space of the vessel (1) is minimized through accurate fitment of the nozzle (3) and the intensive zone (4); that is, by virtue of the feed via (11) and the wiping off at (5), the pump (6) has just sufficient free liquor available for the proper functioning of the pump (6).

The apparatus of the invention provides level impregnation or dyeing, for example with reactive dyes, on a textile fabric rope in a very short liquor, preferably 2.5:1 to 4:1, particularly preferably 2:1 to 3.5:1, without creating unlevelness or marking on the material. One of the reasons this is particularly surprising is that the dyeing of pure cotton articles with reactive dyes according to the prior art requires a liquor ratio of at least about 5:1—and this frequently only because the jet nozzle is additionally driven with air or steam to transport and advance the fabric. The apparatus of the invention consequently differs from the customary exhaust dyeing in the jet in that the fabric rope to be treated comes into contact with the treatment/transport liquor only in the small vessel (1), the liquor can circulate only within this vessel and so the extremely short liquor ratios mentioned can be achieved in the dyeing process.

It is also possible, if desired, to connect up a plurality of pieces of apparatus according to the invention in series and so wet-process an endless fabric rope according to the invention (continuous procedure). To dye cellulosic textile materials with reactive dyes it is in this case advantageous to continuously impregnate the fabric with dye liquor in a first apparatus of the invention and to apply the necessary fixing alkali in subsequent apparatus of the invention.

In a preferred embodiment, the dyeing process of the invention is carried out as follows:

First, the apparatus of the invention is loaded with a finite rope of the textile material to be wet-processed, preferably to be dyed. For the purpose of fabric transportation, the nozzle (3) can here be driven for example with a colorless liquor containing a wetting agent. However, it is advantageous to impregnate the fabric rope with dyeing liquor before the apparatus is loaded. It is also possible to pull one end of the fabric rope manually through the apparatus of the invention by means of a lead rope. After the fabric rope has been introduced, its ends are sewn together. Thereafter, the pump (6) is very rapidly supplied with the colored impregnating liquor, via a makeup vessel and feed line (11), in such a way that at all times—even at high running speeds—there is still just a sufficient amount of free liquor available for operating the nozzle (3) and the total amount of liquor is sufficient to impregnate the total rope. With a lot size of 100 kg, for example, 300 liters of transportation and impregnating medium are sufficient, which makes a liquor ratio of 3:1. This amount, it will be appreciated, is dependent on the liquor retention capacity of the textile fabric rope and can vary within wide limits. In the case of dyeing with reactive dye, two to five passages through the vessel (1) with the intensive zone (4) are then followed by the addition to the impregnating unit, via the feed line (11), of the alkali required for fixing the dye. This takes place either by removing liquid from the circulation system via the drain (8) and dissolving the alkali therein and then returning it to the circulation system or, better, by dissolving the alkali by means of additional liquid and then rapidly adding it to the transportation medium. The ultimate result is a liquor ratio of about 3.5:1. The addition of the total alkali and a defined post-running time are followed by the start of the washoff process of the type customary for dyeings with reactive dyes. The dyeing process with reactive dyes is as it were completed wet on wet after impregnation of the fabric rope with dyeing liquor by addition of alkali into the apparatus of the invention.

The Examples which follow illustrate the functioning of the apparatus of the invention and of the dyeing process of the invention without restricting them in any way to the operative features disclosed therein. The apparatus of the invention is referred to in the Examples as ultrashort liquor impregnator.

EXAMPLE 1

To dye 100 kg of bleached cotton tricot in tubular form, having a weight of about 240 g/m$^2$, in an ultrashort liquor impregnator, the material is transported as a finite tube through the jet nozzle driven by the treatment liquor. The procedure adopted is as follows:

First, the start of the fabric rope is pulled into and through the machine by means of a lead rope and the ends are sewn together. At the same time, the makeup vessel is used to make up 300 liters of a hot liquor at 60° C. containing 1 g of a nonionic wetting agent per liter. The complete fabric rope is then transported by the jet nozzle, driven by treatment liquor, through the ultrashort liquor impregnator and plaited down in a provided scray, from where the fabric rope is then reintroduced into the treatment unit.

After this prewetting, the fabric exhibits a wet pickup of 230%, corresponding to 230 liters of absorbed liquor. The remaining 70 liters of the liquor used are used to drive the pump and the jet nozzle. This freely circulating liquor has 2.2 kg of the reactive dye bearing the Color Index designation C.I. Yellow 027, 2 kg of the reactive dye C.I. Red 242, 6.4 kg of the reactive dye C.I. Black 5, 8.75 kg of anhydrous sodium sulfate, 0.35 kg of a commercially available crease-mark inhibitor dissolved in it and heated up to 60° C. The ultrashort liquor impregnator is restarted and the dye/salt solution is applied in a level manner to the fabric rope for 10 minutes. At the same time, a further makeup vessel is used to prepare the fixing alkali required for finishing the dyeing. To this end, 8.75 kg of sodium sulfate and 12 kg of sodium carbonate are predissolved at 60° C. in 50 liters of water. On completion of the impregnating phase, the entire solution is metered over 15 minutes into the main makeup vessel during the continuous running of the ultrashort liquor impregnator. Following a post-running time of 45 minutes at 60° C., the washoff process can be started. To finish the dyeing, the fabric is initially rinsed twice with 500 liters each time of hot fresh water at 60° C. for 4 minutes in overflow mode. This is followed by a further rinse with 400 liters of fresh water at room temperature, followed by a 10 minute neutralization with 250 liters of water containing 2 ml of acetic acid per liter. This is followed by two soaping steps with 250 liters each time of hot fresh water at 95° C. and a final rinse at 60° C. with 250 liters of water. A black dyeing is obtained with similar fastness properties and depth of shade as obtained on a standard dyeing jet machine under the same dyeing conditions.

EXAMPLE 2

To prebleach and dye 100 kg of a loomstate cotton fabric in rope form, weighing about 180 g/m$^2$, the finite rope of the material is pulled into the machine as described in Example 1 and sewn together.

The makeup vessel is used to make up 300 liters of liquor which contains, per liter, 1 g of an anionic wetting agent, 2 ml of a crease-mark inhibitor, 4 ml of 35% hydrogen peroxide and 4 ml of 33% aqueous sodium hydroxide solution. The solution is heated to 60° C. and applied to the fabric rope by means of the ultrashort liquor impregnator. The temperature is raised to 90° C. and maintained for 15 minutes. The fabric is then overflow rinsed with 500 liters of 80° C. water, followed by 250 liters of 60° C. water. To neutralize the alkaline liquor and destroy excess peroxide, this is followed by a 10 minute rinse with 250 liters of 60° C. water containing, per liter, 3 ml of acetic acid and 2 ml of a commercially available peroxide-destroyer. This is followed by a rinse at 60° C. with 250 liters of water and by a rinse at 40° C., again with 250 liters of water. The water retention capacity of the fabric on leaving the impregnator is around 220%, corresponding to 220 liters of water. The makeup vessel and the circulation system of the ultrashort liquor impregnator contain another 80 liters or so of water as freely circulating liquor.

The moist material is now dyed in the same apparatus. This is done by the procedure of Example 1.

The free liquor has dissolved in it, at 60° C., 400 g of the reactive dye C.I. Yellow 176, 600 g of the reactive dye C.I. Red 239, 4000 g of the reactive dye C.I. Blue 182, 5250 g of anhydrous sodium sulfate, 350 g of a commercially available crease-mark inhibitor and about 100 g of a commercially available wetting agent. The ultrashort liquor impregnator is then restarted and the dye/salt solution is applied in a level manner to the fabric rope for 10 minutes. At the same time, the fixing alkali required for finishing the dyeing is prepared. To this end, 5.25 kg of sodium sulfate and 10 kg of sodium carbonate are predissolved at 60° C. in 50 liters of water. On completion of the impregnating phase, the entire solution is metered over 15 minutes into the main makeup vessel during the continuous running of the ultrashort liquor impregnator. Following a post-running time of 45 minutes at 60° C., the washoff process can be started. The dyeing is finished as described in Example 1 to give a blue dyeing having a fastness level which is in no way inferior to a dyeing produced in a longer liquor.

The overall time for the process, including the prebleach, was 3 hours and 30 minutes. The water consumption is 38 liters per kg of dyed material and hence is around 50% below the water quantities typical of prior art processes.

EXAMPLE 3

To dye 100 kg of mercerized cotton jersey in tubular form, having a weight of about 180 g/m$^2$, a finite tube of the material is wetted with the treatment liquors by means of the ultrashort liquor impregnator.

The fabric is initially impregnated in the treatment unit in a liquor ratio of 2.5:1, corresponding to 250 liters of liquor, with a 60° C. dye solution containing 350 g of the reactive dye C.I. Yellow 125, 360 g of the reactive dye C.I. Red 158, 120 g of the reactive dye C.I. Blue 209, 7000 g of anhydrous sodium sulfate, 300 g of a commercially available crease-mark inhibitor and about 200 g of a commercially available wetting agent and transferred into the scray, from where the fabric is reintroduced into the impregnator.

After five passages through the dye solution in the impregnator, the fixing alkali solution required for finishing the dyeing plus 100 percent, based on the fabric weight, are added. To this end, 7000 g of anhydrous sodium sulfate and 5000 g of sodium carbonate are dissolved in 100 liters of water, heated to 60° C. and supplied to the suction side of the pump over 15 minutes. The residence time in the scray is customarily 2 minutes and depends on the fabric quantity and circulation speed. After a running time of 30 minutes, the dyeing is washed with water and finished with the customary aftertreatment liquors as described in Example 1.

The result obtained is a light brown dyeing having similar fastness properties and depth of shade as are obtained on practicing a customary batch process in a dyeing jet at a liquor ratio of 10:1.

What is claimed:

1. Apparatus for the wet-processing of circular knits and wovens, essentially comprising a vessel comprising a fabric inlet, at least one nozzle for applying a treatment liquor, an intensive zone and a fabric outlet connected to wiping means for engaging the circular knits and wovens, wherein said vessel does not include a scray and has a minimized dead space through accurate fitment of said nozzle and said intensive zone into said vessel, and means constructed and arranged to recirculate treatment liquor from a downstream location back to the at least one nozzle.

2. Apparatus as claimed in claim 1, wherein the vessel has a cubic capacity of less than 150 liters.

3. Apparatus as claimed in claim 1, wherein the vessel has a cubic capacity of 60 to 120 liters.

4. Apparatus as claimed in claim 1, used for impregnating or dyeing a textile fabric rope in a liquor ratio of 2.5:1 to 4:1.

5. Apparatus as claimed in claim 1, used for impregnating or dyeing a textile fabric rope in a liquor ratio of 2:1 to 3.5:1.

6. A process for the wet-processing of textile material, performed in apparatus as claimed in claim 1.

7. A process for the wet-processing of textile material, performed in apparatus as claimed in claim 2.

8. A process for the wet-processing of textile material, performed in apparatus as claimed in claim 3.

9. A process for the wet-processing of textile material, performed in apparatus as claimed in claim 4.

10. A process for the wet-processing of textile material, performed in apparatus as claimed in claim 5.

11. Apparatus as claimed in claim 1, wherein the vessel includes at least one opening on an underside portion thereof for drainage of excess treatment liquor.

* * * * *